United States Patent [19]

Ueno

[11] Patent Number: 4,786,194

[45] Date of Patent: Nov. 22, 1988

[54] TYPEWRITER WITH TEXT MEMORY

[75] Inventor: Hideo Ueno, Nagoya, Japan

[73] Assignee: Brother Kogyo Kabushiki Kaisha, Nagoya, Japan

[21] Appl. No.: 598,831

[22] Filed: Apr. 10, 1984

[30] Foreign Application Priority Data

Apr. 11, 1983 [JP] Japan ..... 58-64193

[51] Int. Cl.[4] ..... B41J 21/16; B41J 3/46

[52] U.S. Cl. ..... 400/279; 400/83; 364/519

[58] Field of Search ..... 364/518, 519, 523; 400/280, 83, 279, 63

[56] References Cited

U.S. PATENT DOCUMENTS

| | | | |
|---|---|---|---|
| 3,403,386 | 9/1968 | Perkins et al. | 400/279 X |
| 3,420,164 | 1/1969 | Lee | 400/280 X |
| 3,578,129 | 5/1971 | Kato et al. | 400/280 X |
| 4,212,077 | 7/1980 | Yittorelli | 400/83 X |

FOREIGN PATENT DOCUMENTS

| | | | |
|---|---|---|---|
| 0077465 | 4/1983 | European Pat. Off. | 400/279 |
| 1901716 | 9/1969 | Fed. Rep. of Germany | 400/279 |
| 2429599 | 1/1975 | Fed. Rep. of Germany | 400/279 |
| 1323677 | 7/1973 | United Kingdom | 400/279 |
| 2031626 | 4/1980 | United Kingdom | 400/63 |

*Primary Examiner*—David A. Wiecking
*Assistant Examiner*—James R. McDaniel
*Attorney, Agent, or Firm*—Moonray Kojima

[57] ABSTRACT

An electronic typewriter capable of being changed over in operating mode selectively between a non-print mode and a print mode, during text creating operation, for storing entered data in a text memory. An objective position, to which the print head is to be moved, is decided through calculation when operation mode is changed over again from non-print mode to print mode, after the operating mode has previously been changed from print mode to non-print mode. When the print head is moved toward the right margin on the basis of the calculated result, sheet feed operation is not executed, whereas, when the print head is moved toward the left margin on the basis of the calculated result, the sheet feed operation is executed prior to movement of the print head. Thus, duplicate printing on the recording paper is advantageously avoided.

2 Claims, 3 Drawing Sheets

TYPEWRITER WITH TEXT MEMORY

BACKGROUND OF THE INVENTION

1. Field of the Invention

This invention relates to a typewriter which is capable of being changed selectively between a print mode and a non-print mode during text creating operation.

2. Description of Prior Art

Known are electronic typewriters which are capable of being changed between a print mode and a non-print mode. One example is disclosed in U.S. patent application Ser. No. 479,810 assigned to the same assignee as hereof. In that typewriter, in the non-print mode, input data applied to the typewriter by operating the keyboard, is stored temporarily in a memory and displayed on a display unit, while the printer remains inactive. In the print mode, the input data is displayed on the display unit and is printed out by the printer. The typewriter is provided with a head pbsition register, which stores the position of the print head according to the printing operation; and an input position register which is adapted to be counted up on the basis of the input data applied to the typewriter, by operating the keyboard, for storing the position of a present input character in a current print line.

When this typewriter is operated in the print mode, the input position register or the head position counter is counted up as key operation or printing operation is executed. Initially, the input position register reads the contents of left margin position register and is counted up at each entry of data by the key operation. Upon coincidence of the contents of the input position register with the contents of right margin position register, any entry of data by the key operation is inhibited thereafter. Then, contents of the left margin position register are set again in the input position register by operation of the carriage return key. When the backspace key is operated, the input position register is counted down. When this electronic typewriter is used in the non-print mode, since the printing operation is not executed upon the key operation, the head position register and the input position register are not counted up.

Thus, in a conventional typewriter having no text memory, it has not been necessary to count up the input position register in the non-print mode, whereas in a typewriter having a text memory, the input position register needs to be counted up for formulating a text to be stored in the text memory while a text is being drawn up under the non-print mode. That is to say, the creation of text by use of left margin, right margin and tabulator is impossible. sible.

On the other hand, when the input position register is counted up in the non-print mode, since the contents of the left margin register are set in the input position register at each operation of the carriage return key, the contents of the input position register sometimes becomes smaller than the contents of the head position register. If the typewriter is changed from the non-print mode to the print mode in this state, the printing head is shifted toward the left margin by a distance corresponding to the difference betwecn the respective contents of the input position register and the head position register, and then executes printing operation. Accordingly, the printing head sometimes is shifted to the same position as the character or the like printed in the previous print mode, so that duplicate printing is liable to occur.

SUMMARY OF THE INVENTION

Accordingly, an object of the invention is to improve the prior art and to overcome the aforementioned and other disadvantages and deficiencies of the prior art.

Another object is to provide an electronic typewriter which is capable of preventing duplicate printing of previously printed characters when the typewriter is changed in operating mode from non-print to print mode.

A further object is to provide an electronic typewriter which is capable of improving the quality of printing and is of simple construction.

A still further object is to provide an electronic typewriter which is capable of deciding the direction the recording head must move, the distance through which the print head must move and whether or not line feed motion is necessary to prevent duplicate printing.

DETAILED DESCRIPTION OF PREFERRED EMBODIMENTS

Figure 1:
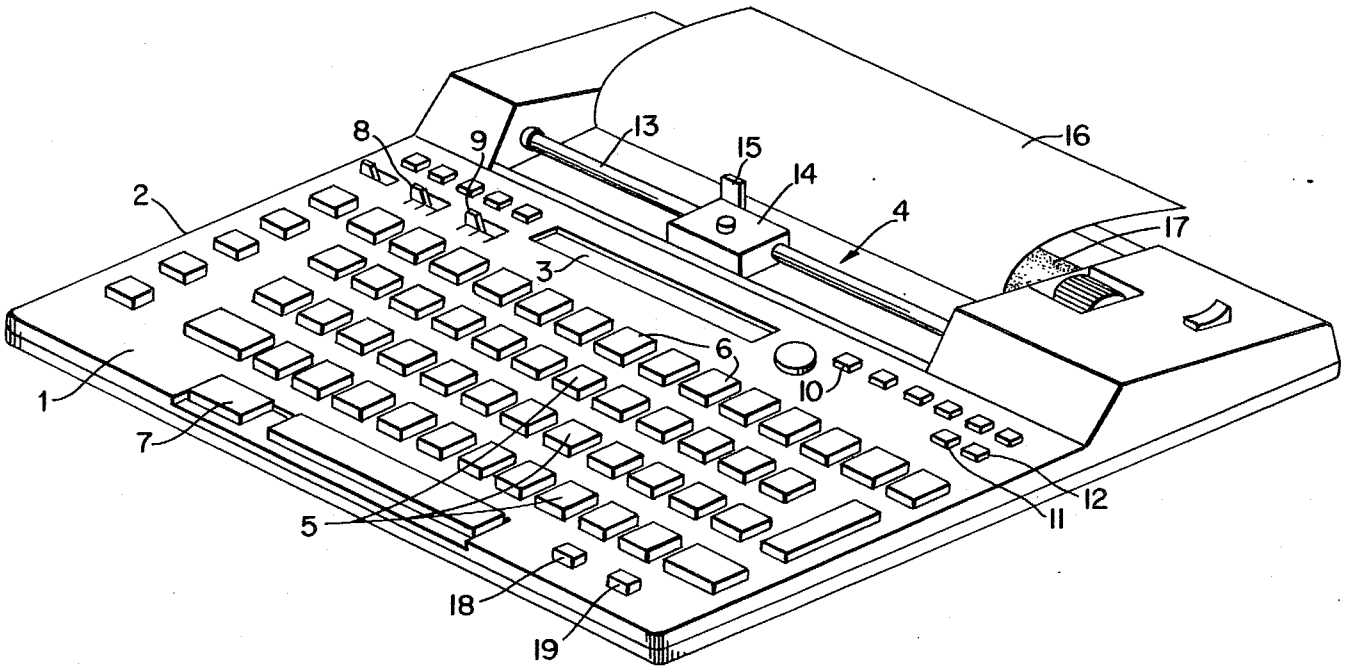
FIG. 1 is a schematic perspective view depicting an electronic typewriter equipped with text memory and embodying an illustrative embodiment of the invention.

Referring now to FIG. 1, the electronic typewriter comprises a keyboard 2, a display unit 3 and a printer 4, which are attached to main frame 1 of the typewriter. Arranged on keyboard 2 are various functional keys, such as a plurality of character keys 5, numeral keys 6, code key 7, mode changeover switch 8, store switch 9, clear key 10, continue key 11, stop key 12, sheet forward feed key 18, and sheet back feed key 19. Mode change over switch 8 changes the operating mode of the typewriter between a non-print mode and a print mode or direct print mode. In the non-print mode, input data, such as character data and numeral data from keyboard 2 is stored in a temporary memory **26*a* , which will be describe hereinafter with reference to FIG. 2, and displayed on display unit 3**.

In the print mode, the input data from keyboard 2 is stored in temporary memory **26*a* , and displayed on display unit 3. Then, the characters, and the like, of data are printed on the basis of data which has overflowed the number of digits of display unit 3. In the direct print mode,a print head 15 performs printing operation as in the print mode. In the direct print mode, characters, and the like, corresponding to input data from keyboard 2 are displayed on display unit 3 and printed by printer 4**.

Store switch 9 has three positions, namely, a normal mode position, a text creating mode position, and a data receiving mode position, to which store switch 9 is changed over selectively. In the text creating mode, input data from keyboard 2 is stored in text memory **26*f* (see FIG. 2) of a random access memory (RAM) 26, which will be described hereinafter with reference to FIG. 2, to enable the creating of a document. In the data receiving mode, printing operation is executed on the basis of data entered in the typewriter by an external apparatus, such as a host computer, not shown. Code key 7 is used, in combination with character keys 5, when store switch 9 is moved to the text creating mode position, for subjecting a document stored in text memory 26***f* to enable text operation such as addition,deletion or printing of a document.

Stop key 12 is used for stopping the printing of a document stored in text memory 26*f* in the subsequent line or for disconnecting the typewriter from an external apparatus when the store switch 9 is moved to the data receiving mode position. When continue key 11 is depressed, after the printing of the document stored in text memory 26*f* has been stopped by operating stop key 12, printing on the subsequent line is continued, or the typewriter is connected to an external apparatus when store switch 9 is moved to the data receiving mode position. When the clear key 10 is depressed with store switch 9 moved to the data receiving mode position, the data entered in and stored in print buffer memory 26*e* , is deleted. Sheet forward feed key 18 is used for turning platen 17 in a normal direction to feed a sheet of heat-sensitive paper , for example, as a printing paper, in a direction perpendicular to the printing line. Sheet backward feed key 19 is used for turning platen 17 in a direction perpendicular to the printing line. Since the respective functions of various keys and switches arranged on keyboard 2, other than those described hereinbefore, are described in the above-mentioned copending application Ser. No. 479,810, description thereof at this time is omitted for sake of clarity of description.

Display unit 3 has a predetermined number of displaying digits which is smaller than the number of digits corresponding to one printing line. Characters, numerals and function symbols such as sheet forward feed and sheet backward feed symbols corresponding to input data from keyboard 2 are displayed on display unit 3 in dot matrixes. In this embodiment, display unit 3 is a liquid crystal display unit.

When mode changeover switch 8 is moved to print mode or direct print mode position, printer 4 prints out input data, such as character data or numeral data from keyboard 2. When store switch 9 is moved to the text creating mode position, and print start code is entered through the combined operation of code key 7 and a prescribed character key 5,printer 4 prints out the text stored in text memory 26*f* . Furthermore, when store switch 9 is moved to the data receiving mode position, printer 4 prints out data entered by an external apparatus connected to the typewriter. Printer 4 has a carriage 14 which reciprocates on a guide shaft 13 extending in parallcl to the axis of platen 17, and fixed to frame 1. A thermal print head 15 having an array of a plurality of heating elements is mounted on carriage 14. The heating elements are energized selectively according to printing data to print characters and the like, on heat sensitive paper 16, in dot matrixes. Although thermal head is used, other types of print heads can be used with suitable printing paper.

Figure 2:
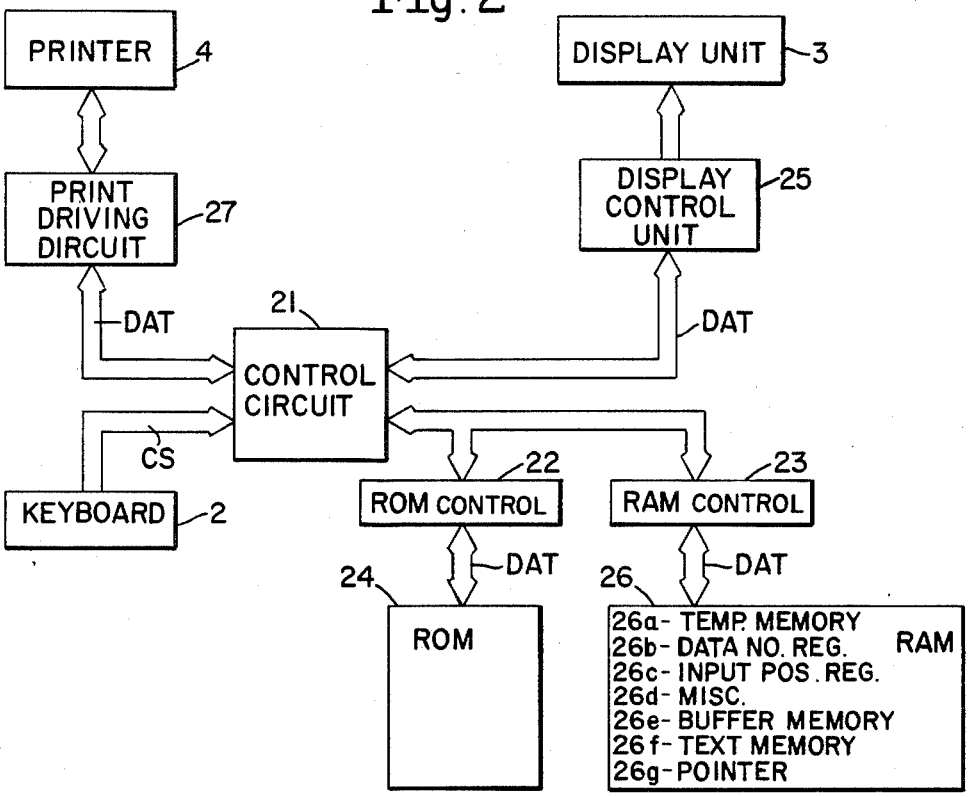
FIG. 2 is a block diagram depicting an electronic circuit of the embodiment.

Referring to FIG. 2, when the keys of keyboard 2 are operated with mode change over switch 8 moved to the nonprint mode position, control circuit 21 sends signals CS corresponding to operated character keys 5 or numeral keys 6 of keyboard 2 , to read only memory (ROM) control circuit 22. ROM control circuit 22 makes access to data DAT corresponding to code signals CS from ROM 24 in which a pattern data corresponding to the characters,numerals and function symbols are written beforehand, and then sends data DAT to a RAM control circuit 23, and to display control circuit 25.

RAM control circuit 23 stores data DAT applied thereto in rewritable temporary storage 26*a* of a RAM 26, and determines whether or not data DAT is a printing data. When DAT data is determined to be a printing data, a data number register 26*b* for storing the number of data stored temporary storage 26*a* , is counted up. If the printing data overflow temporary storage 26*a* , data number register 26*b* is counted down. Temporary memory 26*a* has a number of memory digits equal to the number of display digits of display unit 3, for storing characters and the like displayed on display unit 3. RAM 26 has a pointer 26*g* which indicates the predetermined digits of display unit 3. Furthermore, RAM control unit 23 counts up an input position register 26*c* at each entry of data DAT , to make input position register 26*c* store the position of the present input character in one printing line. When a carriage return signal is provided, the count of the input position register 26*c* is reset to the count corresponding to the left margin position.

Display control circuit 25 drives display unit 3 according to data DAT obtained from ROM control circuit 22 so that display unit 3 displays the characters, and the like, corresponding to entered code signals CS sequentially from the left to the right as viewed rn FIG. 1. When store switch 9 is moved to the text creating mode position in the non-print mode, data DAT corresponding to the characters, and the like, overflowing display unit 3, is stored sequentially in text memory 26*f*.

When character key 5 or numeral key 6 is depressed after mode change over switch 8 has been moved to the print mode position, control circuit 21 drives display unit 3 according to entered data DAT, in a manner similar to the above described operation, so that display unit 3 displays the character or the like. When characters, or te like, overflow the display digits of display unit 3, sequentially, as data DAT is entered from keyboard 2, control circuit 21 make buffer memory 26*e* store printing data, such as characters and numerals among data DAT shifted from access to ROM 24 according to printing data DAT stored in buffer memory 26*e* and sends a pattern data read from ROM 24 to a printing driving circuit 27. Print driving circuit 27 drives printer 4 according to input data DAT, to print the characters, and the like, which have overflowed display unit 3, onto heat sensitive sheet 16. Control circuit 21 makes head position register 26*d* count up as print head 15 of printing unit 4 moves, so that the present position of print head 15 is stored. When store switch 9 is changed over to the text creating mode position,in the print mode, data DAT corresponding to the characters, and the like, which have overflowed display unit 3, is written sequentially in text memory 26*f*. The operation with the mode change over switch 8 moved to the direct print mode position is described in copending application Ser. No. 479,810 and a descriptlon thereof is omitted hereat for clarity of description.

Figure 4A:
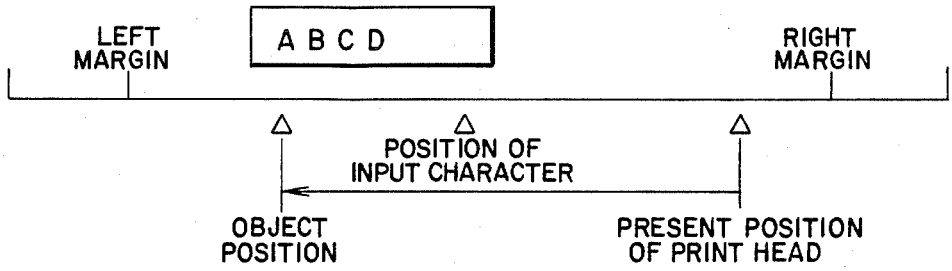
FIGS. 4A and 4B are explanatory diagrams depicting modes of movement of the print head relative to the printing line.
Figure 4B:
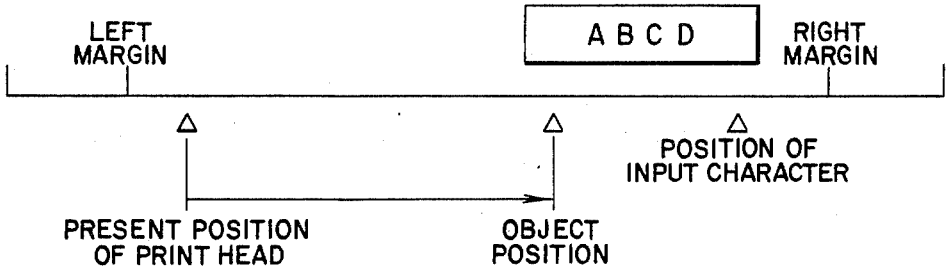
Figure 3:
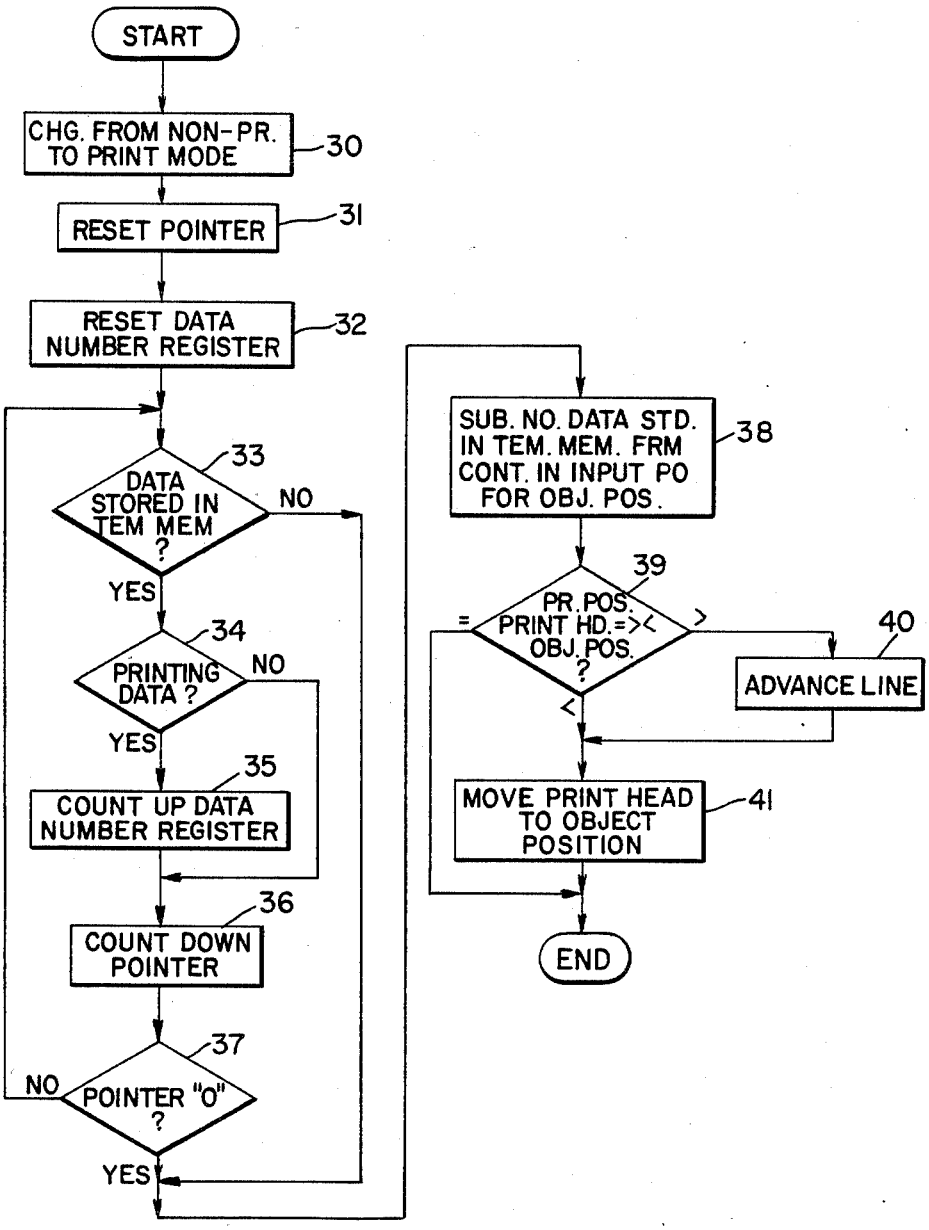
FIG. 3 is a flow chart depicting the operation of the circuit of FIG. 2 when the operating mode is changed from non-print mode to print mode.

Referring to FIGS. 3, 4A, and 4B, when after START, mode change over switch 8 is switched from non-print mode to print mode during text creating, as shown in step 30, control circuit 21 resets pointer 26*g*, at step 31, and sets the count of pointer 26*g* to a count corresponding to the maximum displayable digit of display unit 3. Then, at step 32, control circuit 21 resets data number register 26*b* to "0". At step 33, determination is made whether or not data DAT is stored in temporary storage 26*a*.

If the determination is YES, control circuit 21 determines at step 34, whether or not data DAT indicated by pointer 26*g* is a printing data DAT.

If the determination is YES, control circuit 21 makes at step 35, data number register 26*b* count up one count. After the completion of those operation, or when the input data DAT is a functional data, such as a sneet forward feed data or a sheet backward feed data , e.g. NO in step 34, the contents of pointer 26*g* are counted down at step 36. At step 37, determination is made whether or not the count of pointer 26*g* is "0" to indicate the lowest digit. If the determination is NO, the control step returns to step 33, to determine the digit indicated by pointer 26*g*.

On the other hand, if the determination in step 37 is YES, or determination at step 33 is NO , reference is made to input position register 26*c* , and data number register 26*b* at step 38, to find an objective position to which print head 15 should be moved. At step 39, the discrepancy between the present position of print head 15 in the printing line stored in head position register 26*d* and the objective position is examined. If the present position of print head 15 is advanced further than the objective position,that is, the print head 15 is located nearer to the right margin with respect to the objective position as shown in FIG. 4A, at step 40, heat sensitive sheet 16 is fed by one printing line by turning platen 17, and then print heat 15 is moved to the objective position. Consequently, print head 15 is allowed to start printing operation from the objective position.

On the other hand, when the present position of print head 15 is located before the objective position, that is, when print head 15 is located nearer to the left margin with respect to the objective position, as shown in FIG. 4B, print head 15 is moved to the objective position, at step 41 and the process is ended.

When the present position of print head 15 coincides with the objective position, the print head 15 remains at the same position and the process is ended.

Thus, in this embodiment, since print head 15 is actuated for printing operation, after line feed, when the count of head position register 26*d* is greater than the count of the objective position as calculated on the basis of the counts of input position register 26*c* and printing data register 26*b* and upon changeover of the operating mode by moving mode change over switch 8, for non-print mode position, to print mode position. Thus, duplicate printing of characters and the like, printed previously on the paper is avoided.

When the operating mode is changed over from non-print to direct print mode, print head 15 is moved, as in the above case, to the objective position. After the print head has been moved to the objective position, the contents of temporary storage 26*a* is transferred sequentially to buffer memory 26*e*, to print out data stored in temporary storage 26*a*.

The foregoing description is illustrative of the principles of the invention. Numerous modifications and extensions thereof would be apparent to the worker skilled in the art. All such modifications and extensions are to be considered to be within the spirit and scope of the invention.

What is claimed is:

1. An electronic typewriter having a text memory and being capable of storing input data from a keyboard sequentially in said text memory, said typewriter comprising a printer have a print head movable along a printing line of a recording paper;

means for feeding sheet of said recording paper;

a display unit having digits of a number smaller than number of characters to be printed in one printing line;

a temporary memory for sequentially storing input data entered from said keyboard;

change over means for selectively changing over operational mode between a non-print mode wherein contents of said temporary memory are indicated on said display unit while said printer remains inactive, and a print mode wherein contents of said temporary memory are indicated on said display unit and are concurrently printed out by said printer;

a printing head position register for storing present position of said print head along a printing line;

a data number register for storing number of data stored in said temporary memory;

an input position register for storing present input position of present input character in a printing line;

calculating means for calculating a position to which said print head is to be moved in response to said operational mode being changed over by said change over means from said non-print mode to said print mode; and control means responsive to said print head register, said change over means, said sheet feed means and said calculating means for controlling movement of said print head to said position calculated by said calculating means in response to the present position of said print head stored in said printing head position register being nearer to left margin than said position calculated by said calculating means, and for controlling movement of said print head to said position calculated by said calculating means after sheet feed operation by said sheet feed means in response to said present position of print head stored in said printing head position register being nearer to right margin than said position calculated by said calculating means.

2. The typewriter of claim 1, wherein said control means controls movement of said print head so that in response to said present position of said print head being nearer to said right margin than said position calculated by said calculating means, said print head is moved to said position calculated by said calculating means after sheet feed operation has been executed, and then contents of said temporary memory are printed out sequentially.

* * * * *